United States Patent [19]

van Nederveen et al.

[11] 4,365,679

[45] Dec. 28, 1982

[54] DRILL BIT

[75] Inventors: Hans B. van Nederveen, Bosch en Duin; Martin B. Verburgh, Amersfoort, both of Netherlands

[73] Assignee: SKF Engineering and Research Centre, B.V., Nieuwegein, Netherlands

[21] Appl. No.: 212,068

[22] Filed: Dec. 2, 1980

[51] Int. Cl.[3] ..... B21K 5/02; E21B 10/22; E21B 10/50

[52] U.S. Cl. ..... 175/371; 76/108 A; 175/374; 419/8

[58] Field of Search ..... 175/409, 410, 371, 374, 175/375; 51/307, 309; 76/108 A, 108 R; 75/200, 221

[56] References Cited

U.S. PATENT DOCUMENTS

| | | | |
|---|---|---|---|
| 3,453,719 | 7/1969 | Feenstra | 76/108 A X |
| 3,757,879 | 9/1973 | Wilder et al. | 175/409 X |
| 4,054,426 | 10/1977 | White | 51/309 |
| 4,173,457 | 11/1979 | Smith | 51/309 |
| 4,198,233 | 4/1980 | Frehn | 75/200 X |
| 4,274,769 | 6/1981 | Multakh | 76/108 R X |
| 4,276,788 | 7/1981 | van Nederveen | 76/108 A |

*Primary Examiner*—Stephen J. Novosad
*Attorney, Agent, or Firm*—Eugene E. Renz, Jr.

[57] ABSTRACT

A drill bit with cutting teeth for drilling in rock comprising:

a core member having raceways for rolling elements for rotation of the drill bit, a supporting layer exteriorly shaped to define cutting teeth and formed of highly compacted sintered powder material of substantially 90% density, isostatically bonded to said core member, a wear resistant layer applied by thermal spraying and covering only the portions of the cutting teeth which upon drilling directly contact the rock, said wear resistant layer and said supporting layer being isostatically compacted hot which combined are of substantially 99% density, said layers having a solid bond therebetween providing a drill bit of superior mechanical properties including high resistance to wear and chipping.

4 Claims, 2 Drawing Figures

DRILL BIT

BACKGROUND AND SUMMARY OF THE INVENTION

The invention relates to a method for producing an object on which an exterior layer is applied by thermal spraying, followed by a heat treatment, and to an object, in particular a drill bit, obtained pursuant to this method.

Such a method is disclosed in British Pat. No. 1,367,762. In application of the method described above to objects wherein it is required that the exterior layer applied be capable, in operation, of withstanding great variable forces, for example, that it must be resistant to wear, however, it happens that this layer sometimes chips off, thus shortening the life of the object obtained.

The invention accordingly procures a method of the type mentioned at the beginning, characterized in that on a core member is applied, by cold isostatic compacting, a layer of a suitable powder material, followed by sintering, after which the exterior layer, which is a wear-resistant layer, is applied and then the structure thus obtained is isostatically compacted hot.

It has been found that a suitable powder material for this purpose is a nickel-containing alloy steel powder with preferably 3.5% nickel therein.

The invention in addition procures a drill bit with cutting teeth provided with a wear-resistant layer, for drilling in rock.

For the performance of a method pursuant to the invention a supply of powder material is introduced into a rubber mold and distributed, after which the core member, which is usually a type of steel suitable for a bearing, is placed in the powder, following which the powder is pressed on. The core member may alternatively be placed in the mold first, after which the powder material is introduced and pressed on. The mold is closed and is then isostatically compacted cold until a coherent member having a density of approximately 90% is obtained. The compact removed from the mold is then sintered in a furnace. After cooling the sintered object is coated with a wear-resistant layer by thermal spraying, for example plasma spraying, after which the structure thus obtained is isostatically compacted hot. This hot isostatic compacting may be done by inserting the entire object in a thin-walled deep-drawn vessel or container of low-carbon steel having a wall thickness of approximately 0.5 mm, filled with a ceramic powder. This vessel is then heated and placed under pressure on all sides. After hot isostatic compacting the object may be readily separated from the surrounding ceramic mass and cleaned by sand blasting. This method proves to procure components with accurately shaped dimensions comparable to those of a forged product.

When a drill bit for rock is produced in this fashion, after sintering not the entire surface of the cutting teeth but only the parts thereof which come directly into contact with the rock are coated with the wear-resistant layer by thermal spraying. Following the selective application of the wear-resistant layer the preformed drill bit is subjected in its entirety to hot isostatic compacting, as described above.

DESCRIPTION OF THE DRAWING

The invention is now explained in greater detail by means of the accompanying drawing, which represents a preferred embodiment of the invention.

DESCRIPTION OF THE PREFERRED EMBODIMENT

Figure 1:
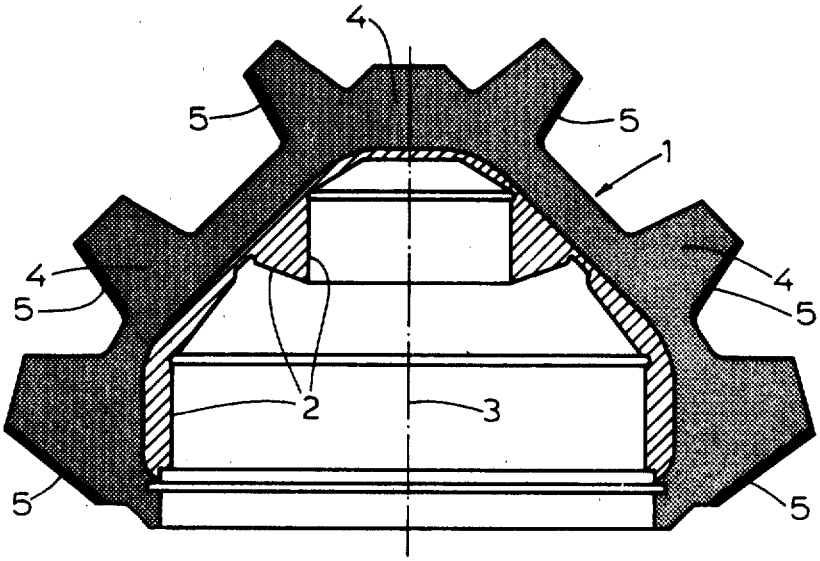
FIG. 1 is a cross section of a drill bit produced according to the invention.

The drill bit 1 shown in FIG. 1 is composed of a core member 3, made of a bearing material, in which are applied the races 2 for the rolling elements (not shown). On this core member 3, solid at the beginning, is applied, in a rubber mold, a layer 4 of powder, which combination is isostatically compacted cold. This operation takes place preferably under a pressure of approximately 6000 atmospheres at room temperature. Then the preformed drill bit, isostatically compacted cold, is removed from the mold and sintered in a sintering furnace at a temperature of approximately 1200° C. at 1 atmosphere under reduction by hydrogen for approximately 1 hour, which operations lead to a density of approximately 90% of the compacted material. Then, by means of plasma spraying technique, the wear-resistant layer 5 is applied on the layer 4 and the object obtained is then inserted into a vessel or container and isostatically compacted hot under a pressure of for example approximately 1600 atmospheres and at a temperature of approximately 1100° C. for at least 2 hours. This operation results in a density of the layers 4 and 5 of 99% and a very solid bond between the layers.

It will be found by the method pursuant to the invention that the mechanical properties of the drill bit thus formed are greatly improved, like the bond between the layers 4 and 5, on the one hand, and the layer 4 and the core member 3, on the other. By this means the desired effect of very high resistance to wear and resistance to chipping of the cutting teeth is obtained, combined with a core member which functionally has other possible applications, such as, for example, the function of a bearing.

It is noted that the original solid core member 3, after mechanical operations and heat treatment, acquires the shape, as represented in FIG. 1, in which the races 2 of the rolling elements are supplied.

Figure 2:
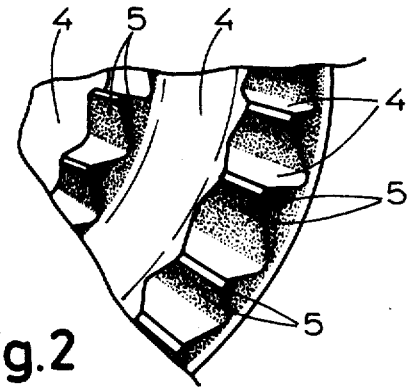
FIG. 2 is a perspective view of a portion of this drill bit.

It may be seen further from FIG. 2 that not the entire surface of the cutting teeth of the drill bit is provided with the wear-resistant layer 5, but that the wear-resistant layer is applied only on the places where the tooth comes directly into contact with rock during operation.

Thus there is procured by the invention a device, such as a drill bit, which in principle consists of three parts, namely, a significantly improved cutting part 5, a supporting part 4 and a core or bearing part 3, which parts are combined in an economically and technically advantageous manner such that the said drill bit satisfies the requirements set.

What is claimed is:

1. A drill bit with cutting teeth for drilling in rock comprising:

a core member having raceways for rolling elements for rotation of the drill bit, a supporting layer exteriorly shaped to define cutting teeth and formed of highly compacted sintered powder material of substantially 90% density, isostatically bonded to said core member, a wear resistant layer applied by thermal spraying and covering only the portions of the cutting teeth which upon drilling directly contact the rock, said wear resistant layer and said supporting layer being isostatically compacted hot which combined are of substantially 99% density, said layers having a solid bond therebetween providing a drill bit of superior mechanical properties including high resistance to wear and chipping.

2. A drill bit as claimed in claim 1 wherein the said supporting layer consists of a nickel-containing alloy steel.

3. A drill bit as claimed in claim 2 wherein said nickel-containing alloy steel contains about 3.5% nickel.

4. A drill bit as claimed in claim 1 wherein said core member is formed by mechanical operations and heat treatment into a bearing for the bearing system of the drill bit.

* * * * *